US008018415B2

(12) United States Patent
Koyama et al.

(10) Patent No.: US 8,018,415 B2
(45) Date of Patent: Sep. 13, 2011

(54) DISPLAY DEVICE AND ELECTRONIC EQUIPMENT

(75) Inventors: Hirotoshi Koyama, Kanagawa (JP); Yoshiharu Nakajima, Kanagawa (JP); Yoshitoshi Kida, Kanagawa (JP); Daisuke Ito, Tokyo (JP)

(73) Assignee: Sony Corporation, Tokyo (JP)

( * ) Notice: Subject to any disclaimer, the term of this patent is extended or adjusted under 35 U.S.C. 154(b) by 885 days.

(21) Appl. No.: 11/979,481

(22) Filed: Nov. 5, 2007

(65) Prior Publication Data

US 2008/0218466 A1 Sep. 11, 2008

(30) Foreign Application Priority Data

Nov. 20, 2006 (JP) ..... P2006-313540

(51) Int. Cl.
*G09G 3/36* (2006.01)

(52) U.S. Cl. ..... 345/96; 345/87; 345/98; 345/209; 345/213

(58) Field of Classification Search ..... 345/87–100, 345/204–215
See application file for complete search history.

(56) References Cited

U.S. PATENT DOCUMENTS 6,958,744 B2 * 10/2005 Nakamura ..... 345/98
2003/0197673 A1 * 10/2003 Nakamura ..... 345/99
2005/0179642 A1 * 8/2005 Wilcox et al. ..... 345/107

FOREIGN PATENT DOCUMENTS

JP 2006-251038 9/2006

OTHER PUBLICATIONS

Japanese Office Action issued Sep. 30, 2008 for corresponding Japanese Application No. 2006-313540.

* cited by examiner

*Primary Examiner* — Vijay Shankar
(74) *Attorney, Agent, or Firm* — Rader, Fishman & Grauer PLLC

(57) ABSTRACT

A display device includes a display unit in which pixels are arranged in a matrix state and a drive circuit selecting respective pixels in the display unit by each row and giving additional potential to pixel electrodes of the pixels by using coupling, in which the drive circuit has a function of allowing the reverse polarity of potential added to pixel electrodes to be a potential which can add suitable voltage to additional potential lines in a frame before adding the additional potential.

10 Claims, 10 Drawing Sheets

DISPLAY DEVICE AND ELECTRONIC EQUIPMENT

CROSS REFERENCE TO RELATED APPLICATIONS

The present invention contains subject matter related to Japanese Patent Application JP 2006-313540 filed in the Japanese Patent Office on Nov. 20, 2006, the entire contents of which being incorporated herein by reference.

BACKGROUND OF THE INVENTION

1. Field of the Invention

The invention relates to an active-matrix display device such as a liquid crystal display device, and electronic equipment using the same.

2. Description of the Related Art

In recent years, portable terminals such as a cellular phone and PDA (personal Digital Assistants) are rapidly becoming widespread. As one of factors for the rapid spread of these portable terminals, a liquid crystal display device mounted as an output display unit thereof can be cited. The reason is that the liquid crystal display device has a characteristic in which electric power is not necessary in principle to drive the liquid crystal display and that it is a low-power consumption display device.

FIG. 1 is a block diagram showing a configuration example of a general liquid crystal display device.

A liquid crystal display device 1 includes an available display area unit 2, a vertical drive circuit (VDRV) 3, and a horizontal drive circuit (HDRV) 4 as shown in FIG. 1.

In the available display area unit 2, plural pixel units 2PXLs are arranged in a matrix state.

Each pixel unit 2PXL includes a thin-film transistor (TFT) 21 as a switching element, a liquid crystal cell LC22 in which a pixel electrode 22 is connected to a drain electrode (or a source electrode) of the TFT 21 and a storage capacitor CS21 in which one of electrodes is connected to the drain electrode of the TFT 21.

With respect to respective pixel units 2PXLs, scanning lines 5-1 to 5-m and storage capacitor line (CS line) 6-1 to 6-m are arranged at each row along the pixel arrangement direction and signal lines 7-1 to 7-n are arranged at each column along the pixel arrangement direction.

Gate electrodes of the TFTs 21 of respective pixel units 2PXLs are connected to the scanning lines (gate line) 5-1 to 5-m respectively so that gate electrodes of each row correspond to the same scanning line. Source electrodes (or drain electrodes) of respective pixel units 2PXLs are connected to the signal lines 7-1 to 7-n respectively so that source electrodes (or drain electrodes) of each column correspond to the same signal line.

Furthermore, in the general liquid crystal display device, ones of electrodes (electrodes opposite to the connected electrodes) of the storage capacitors CS21 of respective pixel units 2PXL are connected to the storage capacitor lines 6-1 to 6-m respectively so that electrodes at each row correspond to the same storage capacitor line.

The respective scanning lines 5-1 to 5-m and respective storage capacitor lines 6-1 to 6-m are driven by the vertical drive circuit 3 and the respective signal lines 7-1 to 7-n are driven by the horizontal drive circuit 4.

In the vertical drive circuit 3, scanners (shift registers) 31, CS latches 32 and gate buffers 33 are connected in series and arranged at respective rows of the pixel arrangement so as to correspond to respective scanning lines 5-1 to 5-m and respective storage capacitor lines 6-1 to 6-m.

The liquid crystal display device 1 having the above configuration applies a drive method of giving additional potential to the pixel electrodes 22 of the pixel units 2PXLs by using coupling.

In the vertical drive circuit 3, a certain pulse is scanned in the scanner (shift register) 31 to generate a GV and CV pulses.

Then, polarity of the FRP pulse is detected by using the GV and GS pulses in the CS latch to generate a CSout pulse to be coupled to the pixel electrode 22.

At this time, a signal Vout for turning on the TFT 21 of the pixel unit 2PXL is generated simultaneously.

Lastly, pulse shaping is performed at the gate buffer 33 and pulses are outputted to the gate lines 5-1 to 5-m and the CS lines 6-1 to 6-m respectively.

SUMMARY OF THE INVENTION

However, in the above general liquid crystal display device, at the time of switching display such as vertical inversion, switching between 1H inversion and 1F inversion, on/off sequence, and an external Vsync mode (External Vsync mode), it is difficult to perform coupling operation normally, therefore, the pixel electrodes do not reach the target potential and abnormality occurs in the display.

Accordingly, various pulse controls have been performed to avoid problems until now, however, problems in the switching between 1H inversion and 1F inversion and the External Vsync mode have not been settled.

There is another problem that the circuit increases and the layout area becomes large by performing the pulse control.

The problem in which the coupling operation is not normally performed at the time of switching display, particularly in the External Vsync mode will be explained in more detail.

FIG. 2 is a view showing a configuration example of the CS latch 32 in the general liquid crystal display device.

FIG. 3 is a timing chart of FIG. 2 in a normal operation.

The CS latch 32 in FIG. 2 includes switches 34, 35, latches (RAMs) 36, 37 and an inverter 38.

In this configuration, the switch 34 is turned on at the timing when the GV pulse is in a high level and the FRP pulse is stored in the latch (RAM) 36.

After that, the switch 35 is turned on at the timing when the CV pulse is in a high level, and signal potential stored in the latch 36 is stored in the latch (RAM) 37 at the next stage to be outputted as CSout through the inverter 38.

In the case of normal drive, operation is performed without problems even in image quality.

FIG. 4 is a timing chart for explaining that the problem occurs, in which the coupling operation is not normally performed at the time of switching display, particularly in the External Vsync mode.

As shown in FIG. 4, when a vertical synchronizing signal Vsync is suddenly inputted from the outside at a timing T1 which is not the regular timing and the vertical synchronizing signal Vsync becomes valid, the scanner (shift register) 31 is reset for maintaining display, and the process moves to an operation to store potential of the pixel electrode 22.

The scanner (shift register) 31 performs scanning operation from the first line again as shown by T2 in the drawing. At this time, the coupling is not performed to the CS line 6 connected relating to the stored pixel electrode 22 as shown by T3 in the drawing.

This is because the polarity of the FRP pulse is inverted by the sudden input of the vertical synchronizing signal Vsync.

The operation causes a problem of generating noise for a moment on the display area and the mode is restricted.

It is desirable to provide a display device capable of canceling the mode which caused problems at the time of switching display and electronic equipment using the same.

According to an embodiment of the invention, there is provided a display device including a display unit in which pixels are arranged in a matrix state and a drive circuit selecting respective pixels in the display unit by each row and giving additional potential to pixel electrodes of the pixels by using coupling, in which the drive circuit has a function of allowing the reverse polarity of potential added to pixel electrodes to be a potential which can add suitable voltage to additional potential lines in a frame before adding the additional potential.

According to an embodiment of the invention, there is provided electronic equipment including a display device, in which the display device has a display unit in which pixels are arranged in a matrix state and a drive circuit selecting respective pixels in the display unit by each row and giving additional potential to pixel electrodes of the pixels by using coupling, in which the drive circuit has a function of allowing the reverse polarity of potential added to pixel electrodes to be a potential which can add suitable voltage to additional potential lines in a frame before adding the additional potential.

According to the embodiments of the invention, when additional potential is given to pixel electrodes of pixels by using coupling, the reverse polarity of potential added to pixel electrodes is applied to additional potential lines as suitable voltage in a frame before adding the additional potential.

According to the embodiments of the invention, there is an advantage that the mode which caused problems at the time of switching display can be cancelled.

DESCRIPTION OF THE PREFERRED EMBODIMENTS

Hereinafter, an embodiment of the invention will be explained in detail with reference to the drawings.

Figure 1:
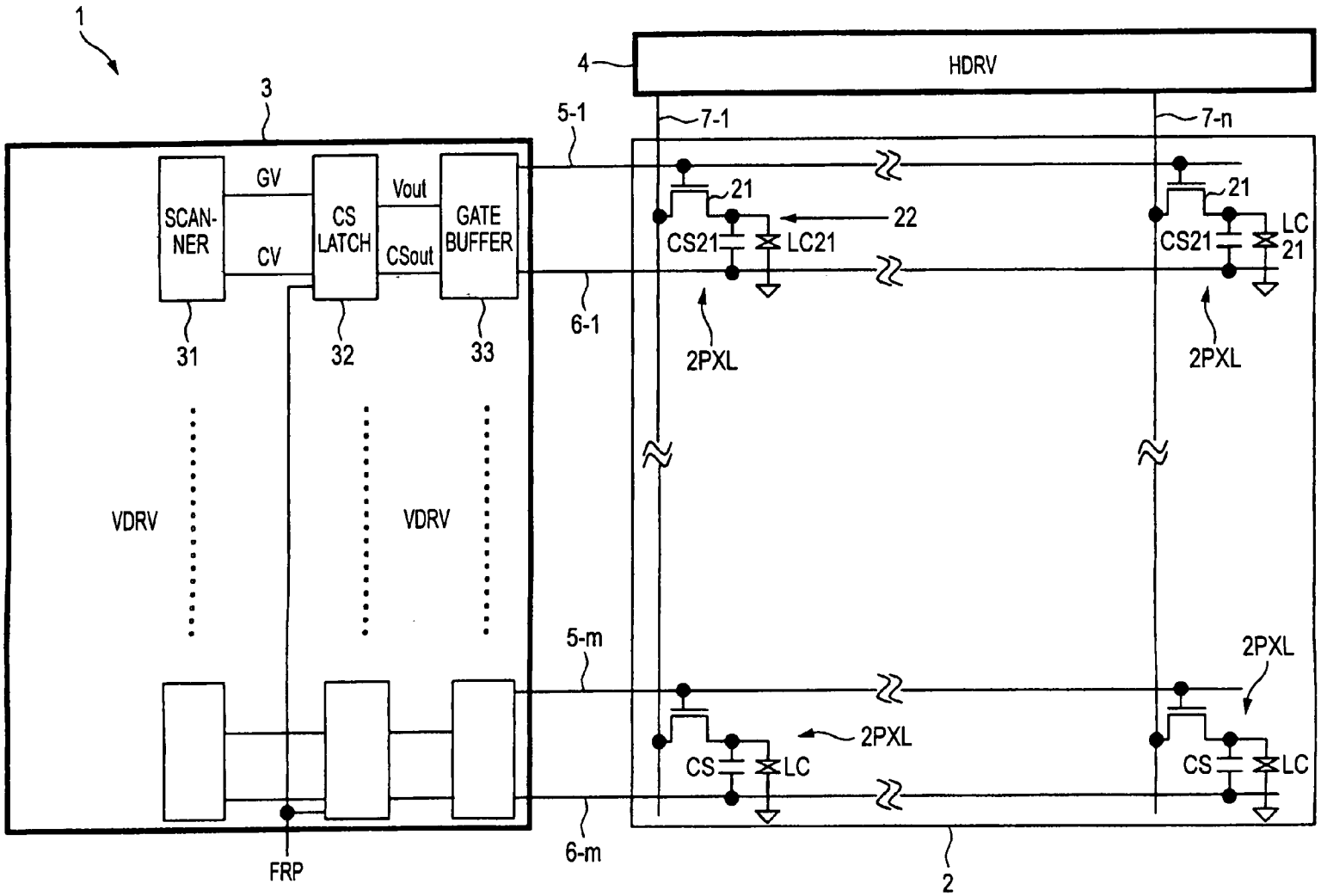
FIG. 1 PRIOR ART
FIG. 1 is a block diagram showing a configuration example of a general liquid crystal display device.
Figure 2:
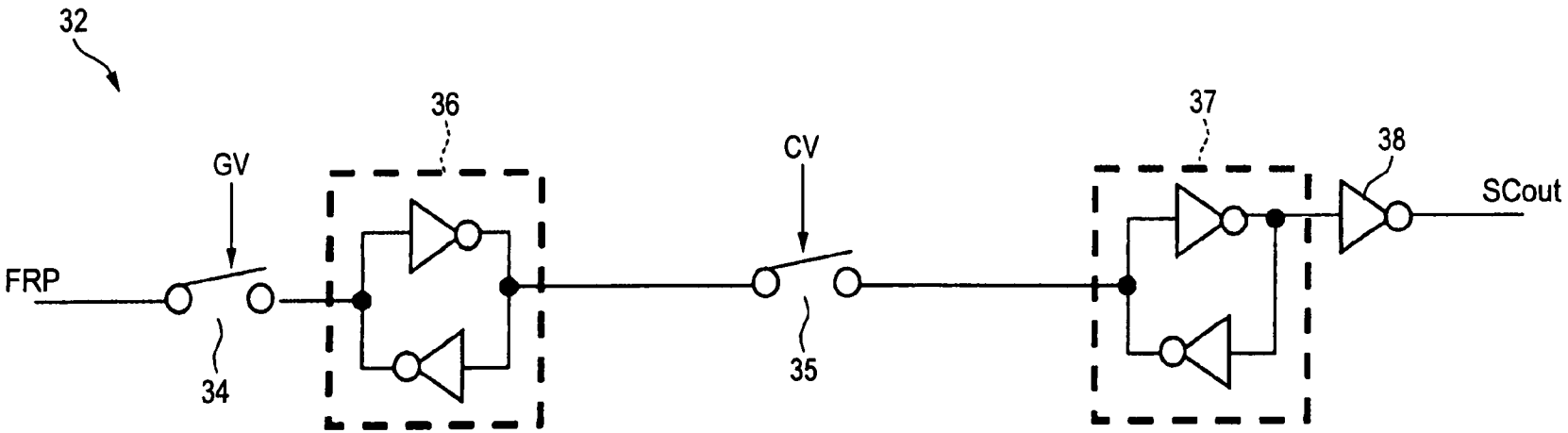
FIG. 2 PRIOR ART
FIG. 2 is a view showing a configuration example of a CS latch in the general liquid crystal display device.
Figure 3:
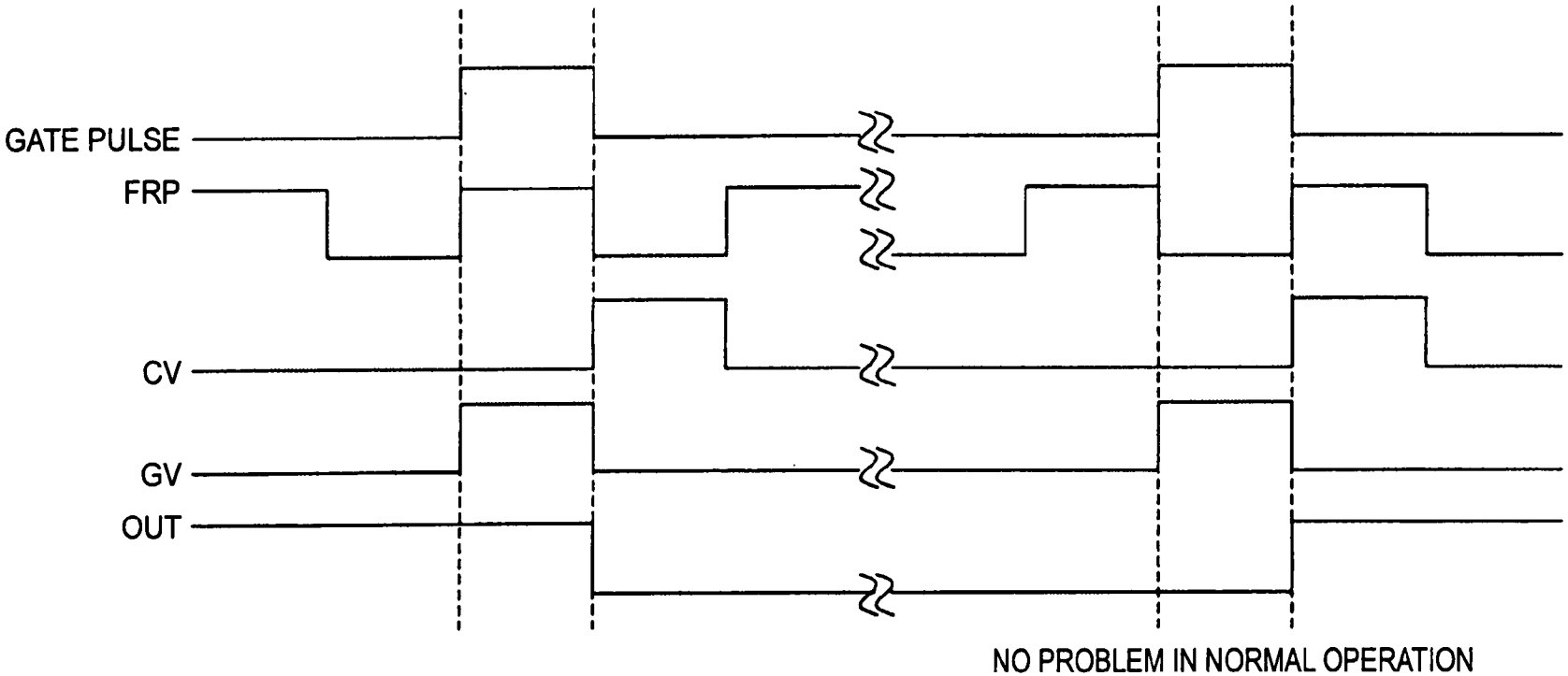
FIG. 3 PRIOR ART
FIG. 3 is a timing chart of FIG. 2 in a normal operation.
Figure 4:
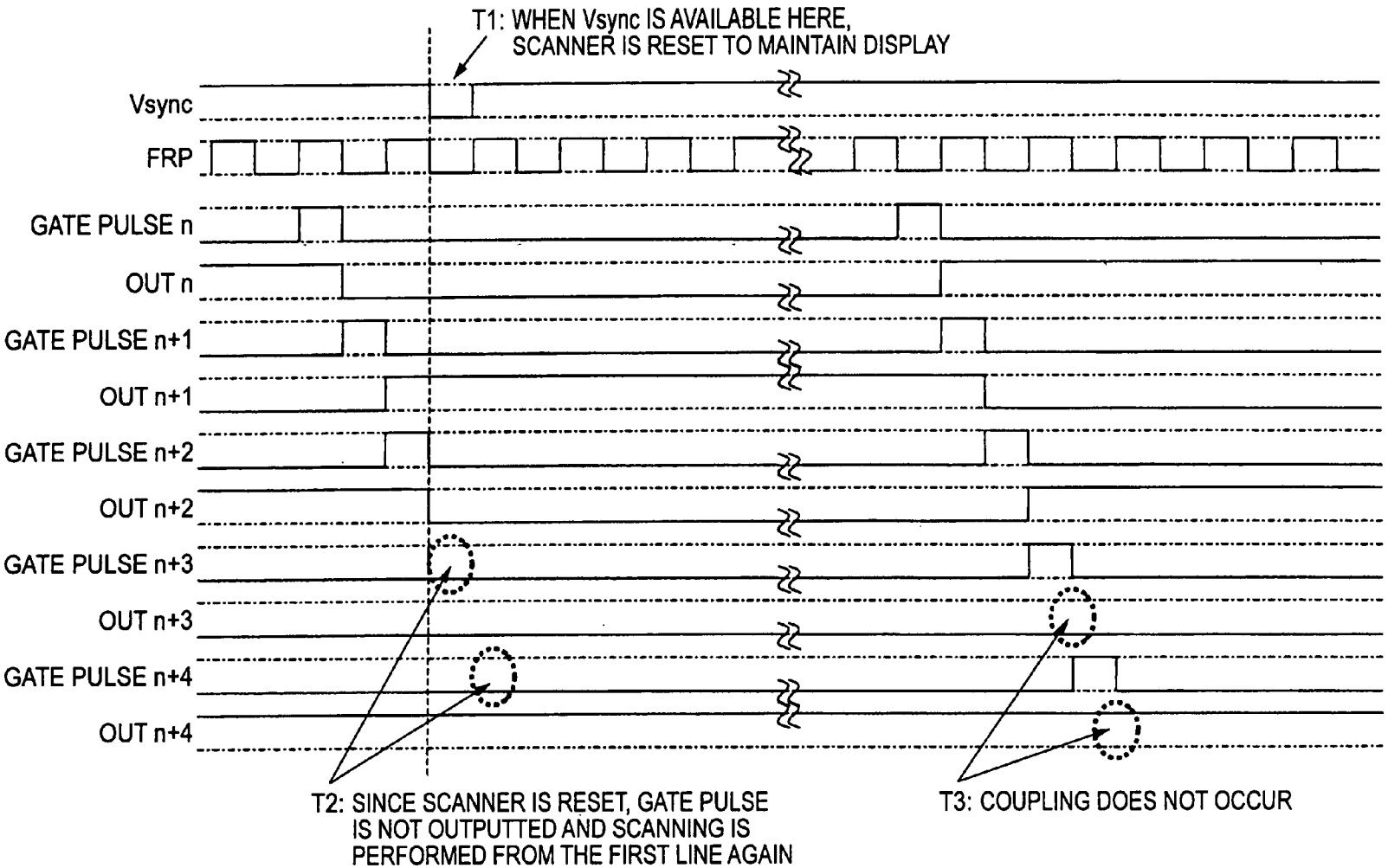
FIG. 4 PRIOR ART
FIG. 4 is a timing chart for explaining that the problem occurs, in which the coupling operation is not normally performed at the time of switching display, particularly in an External Vsync mode.
Figure 5:
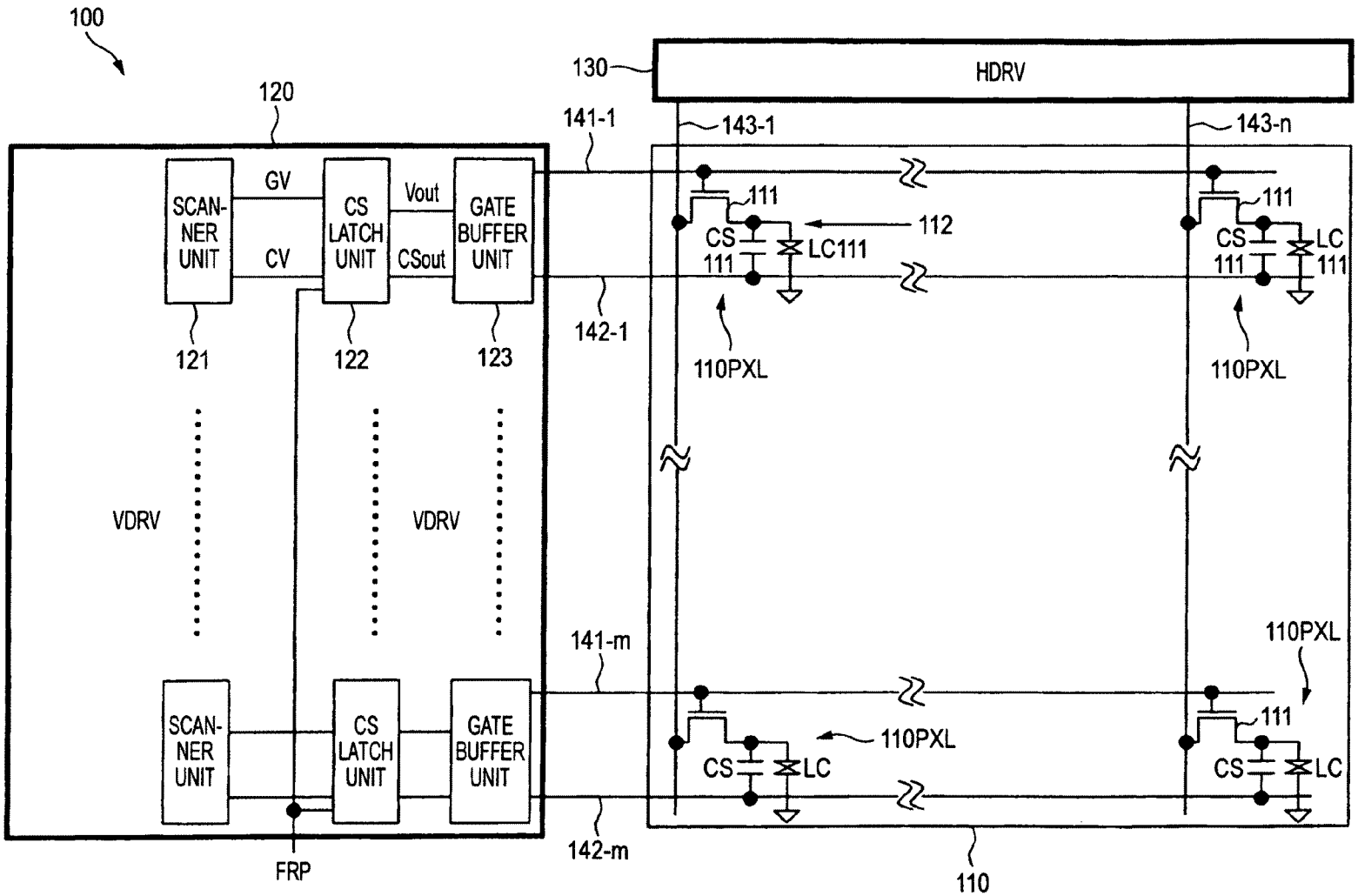
FIG. 5 is a block diagram showing a configuration example of a liquid crystal display device according to an embodiment of the invention.

FIG. 5 is a block diagram showing a configuration example of a liquid crystal display device according to an embodiment of the invention.

The liquid crystal display device 100 includes an available display area unit 110, a vertical drive circuit (VDRV) 120 and a horizontal drive circuit (HDRV) 130 as shown in FIG. 5.

In the available display area unit 110, plural pixel units 110PXLs are arranged in a matrix state.

Each pixel unit 110PXL includes a thin-film transistor (TFT) 111 as a switching element, a liquid crystal cell LC111 in which a pixel electrode 112 is connected to a drain electrode (or a source electrode) of the TFT 111 and a storage capacitor CS111 in which one of electrodes is connected to the drain electrode of the TFT 111.

With respect to respective pixel units 110PXLs, scanning lines 141-1 to 141-m and storage capacitor line (CS line) 142-1 to 142-m which are auxiliary lines as additional potential lines are arranged at each row along the pixel arrangement direction and signal lines 143-1 to 143-n are arranged at each column along the pixel arrangement direction.

Gate electrodes of the TFTs 111 of respective pixel units 110PXLs are connected to the scanning lines (gate line) 141-1 to 141-m respectively so that gate electrodes of each row correspond to the same scanning line. Source electrodes (or drain electrodes) of respective pixel units 110PXLs are connected to the signal lines 143-1 to 143-n respectively so that source electrodes (or drain electrodes) of each column correspond to the same signal line.

Furthermore, in the liquid crystal display device 100, ones of electrodes (electrodes opposite to the connected electrodes) of the storage capacitors CS111 of respective pixel units 110PXL are connected to the storage capacitor lines 142-1 to 142-m respectively so that electrodes at each row correspond to the same storage capacitor line.

The respective scanning lines 141-1 to 141-m and respective storage capacitor lines 142-1 to 142-m are driven by the vertical drive circuit 120 and the respective signal lines 143-1 to 143-n are driven by the horizontal drive circuit 130.

In the vertical drive circuit 120, scanner units (shift registers) 121, CS latch units 122 and gate buffer units 123 are connected in series and arranged at respective rows of the pixel arrangement so as to correspond to respective scanning lines 141-1 to 141-m and respective storage capacitor lines 142-1 to 142-m.

The liquid crystal display device 100 having the above configuration applies a drive method of giving additional potential to the pixel electrodes 112 of the pixel units 110PXLs by using coupling, and the vertical drive circuit 120 has a function of preventing disorder of image quality at the moment of switching a certain function.

Hereinafter, the vertical drive circuit 120 will be explained, focusing on a configuration and a function thereof.

In the vertical drive circuit 120, a certain pulse is scanned in the scanner unit (shift register) 121 to generate a GV pulse as a first pulse and a CV pulse as a second pulse.

Then, polarity of the FRP pulse is detected by using the GV and GS pulses in the CS latch unit 122 to generate a CSout pulse to be coupled to the pixel electrode 112.

At this time, a signal Vout for turning on the TFT 111 of the pixel unit 110PXL is generated simultaneously.

Lastly, pulse shaping is performed at the gate buffer unit 123 and pulses are outputted to the gate lines 141-1 to 141-m and the storage capacitor lines (CS lines) 142-1 to 142-m respectively.

The CS latch unit 122 of the vertical drive circuit 120 according to the embodiment has a function of allowing the reverse polarity of potential added to the pixel electrodes to be a potential which can add suitable voltage to additional potential lines in a frame before adding the additional potential in order to prevent problems in image quality.

Figure 6:
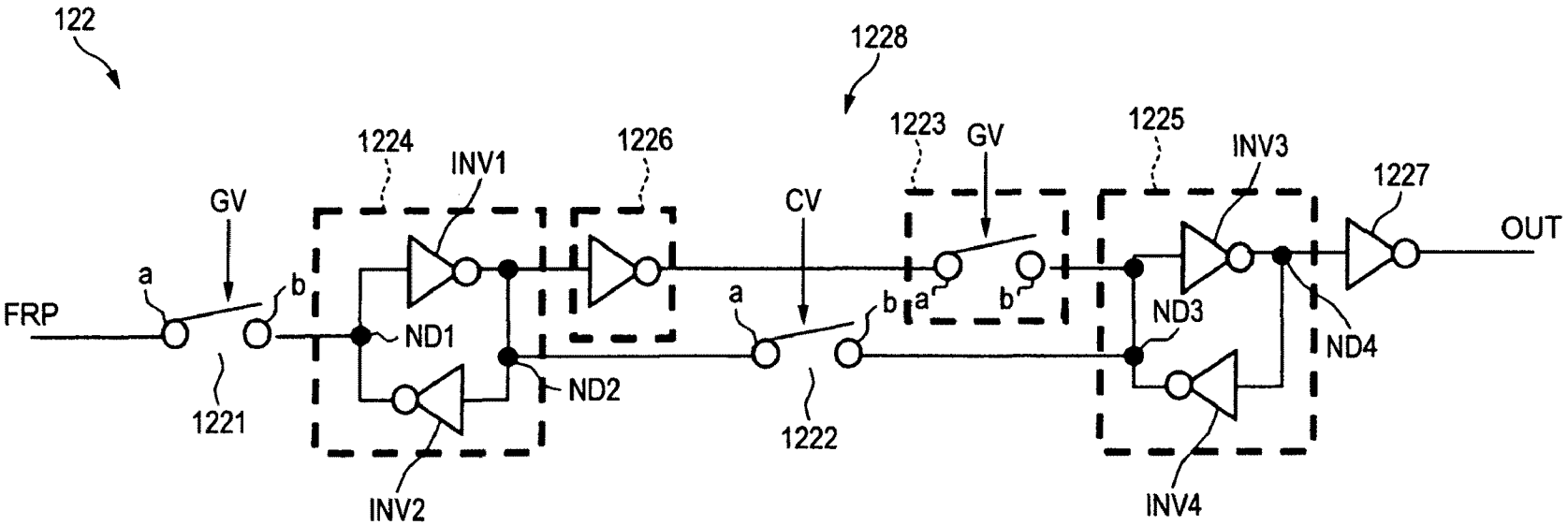
FIG. 6 is a view showing a configuration example of a CS latch in a vertical drive circuit according to the embodiment.

FIG. 6 is a view showing a configuration example of the CS latch in the vertical drive circuit according to the embodiment.

The CS latch unit 120 includes switches 1221, 1222, 1223, latches (RAM) 1224, 1225 and inverters 1226, 1227.

The inverter 1226 and the switch 1223 form an inversion transfer unit 1228.

The switch 1221 is connected to a supply line of the FRP pulse at a fixed contact "a", and connected to an input of the latch 1224 at an operating contact "b".

The switch 1221 is turned on when the GV pulse generated in the scanner unit 121 is in a high level, inputting the FRP pulse to the latch 1224.

The switch 1222 is connected to an output of the latch 1224 at a fixed contact "a" and connected to an input of the latch 1225 at an operating contact "b".

The switch 1222 is turned on when the CV pulse generated in the scanner unit 121 is in a high level, inputting the FRP pulse latched in the latch 1224 to the latch 1225.

The switch 1223 is connected to an output of an inverter 1226 at a fixed contact "a" and connected to an input of the latch 1225 at an operating contact "b".

The switch 1223 is turned on when the GV pulse generated in the scanner unit 121 is in a high level, inputting the FRP pulse latched in the latch 1224 and inverted in the inverter 1226 to the latch 1225.

The latch 1224 is configured by connecting inputs and outputs of inverters INV1, INV2 to each other, in which an input node ND1 is formed by a contact of the input of the inverter INV1 and the output of the inverter INV2, and an output node ND2 is formed by a contact of the output of the inverter INV1 and the input of the inverter INV2.

The input ND1 is connected to the operating contact "b" of the switch 1221 and the output node ND2 is connected to the fixed contact "a" of the switch 1222 and an input of the inverter 1226.

The latch 1225 is configured by connecting inputs and outputs of inverters INV3, INV4 to each other, in which an input node ND3 is formed by a contact of the input of the inverter INV3 and the output of the inverter INV4, and an output node ND4 is formed by a contact of the output of the inverter INV3 and the input of the inverter INV4.

The input ND3 is connected to the operating contacts "b" of the switch 1222 and the switch 1223, and the output node ND4 is connected to an input of the inverter INV1227.

The inverter 1226 is connected to the output node ND2 of the latch 1224 at the input, and connected to the fixed contact "a" of the switch 1223 at the output.

The inverter 1226 inverts the level of the FRP pulse latched in the latch 1224, outputting the pulse to the switch 1223.

The inverter 1227 inverts the level of the pulse latched in the latch 1225, outputting the pulse to the gate buffer unit 123.

Next, operation according to the configuration will be explained with reference to FIG. 7 and FIG. 8.

Figure 7:
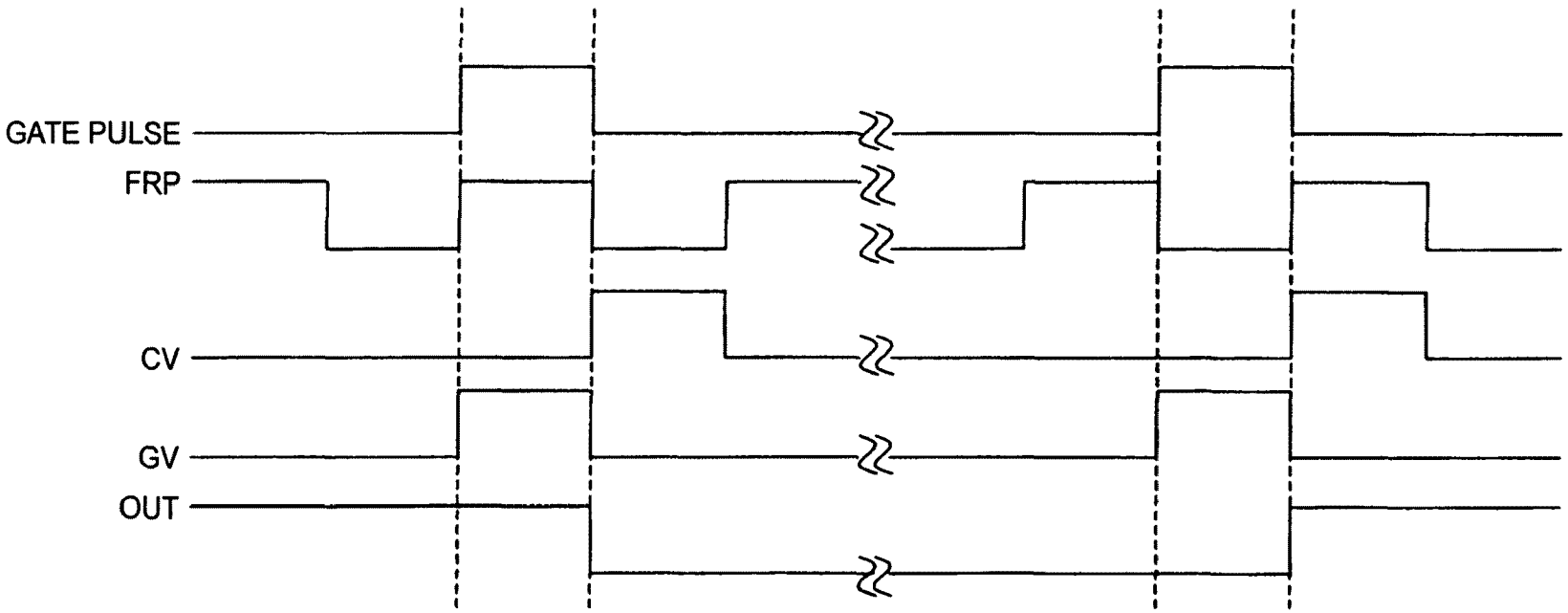
FIG. 7 is a timing chart of FIG. 6 in a normal operation.

FIG. 7 is a timing chart of FIG. 6 in a normal operation.

Figure 8:
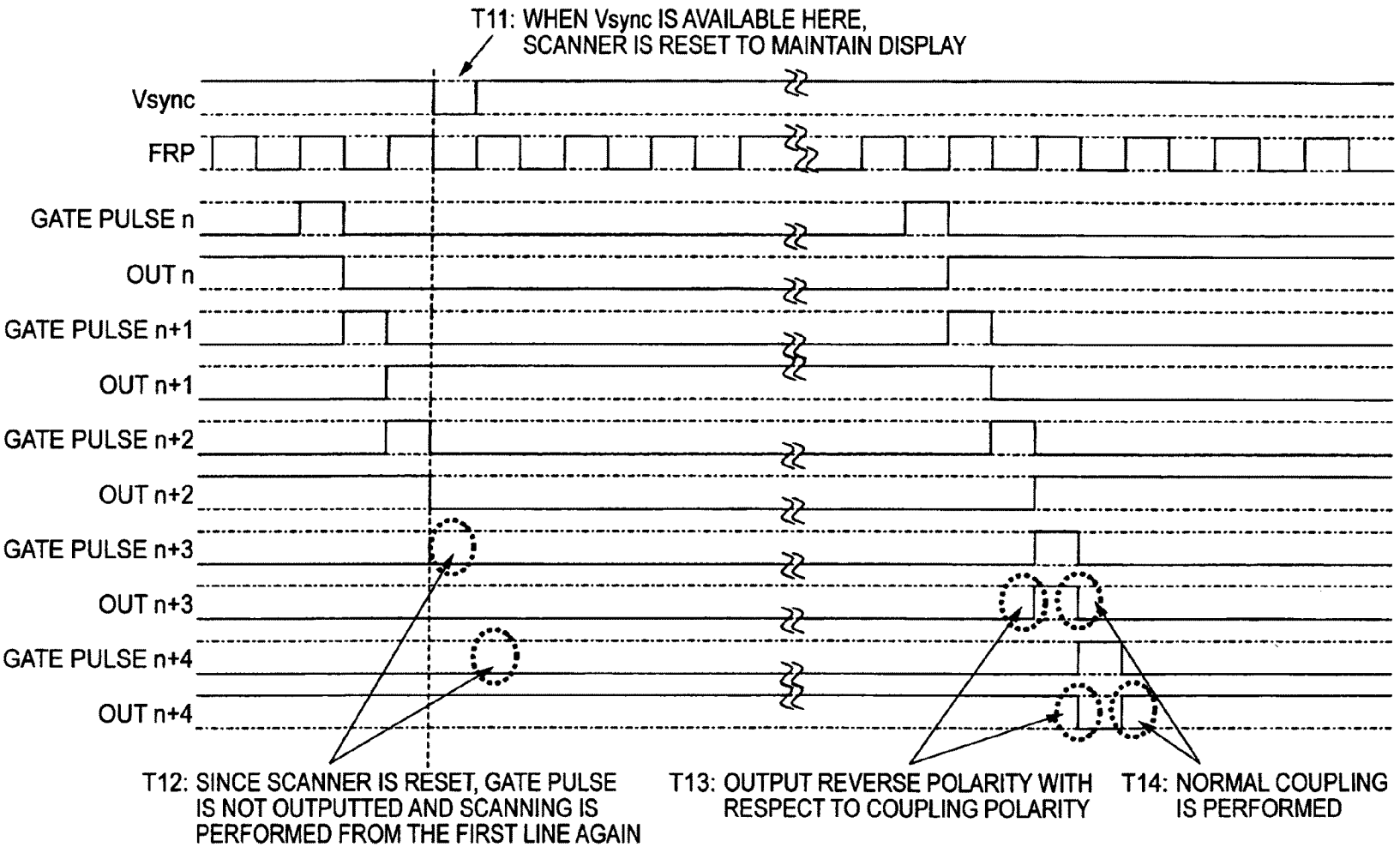
FIG. 8 is a timing chart for explaining operation at the time of switching display, particularly in the External Vsync mode.

FIG. 8 is a timing chart for explaining operation at the time of switching display, particularly in an External Vsync mode.

In the normal operation, the switch 1221 is turned on at the timing when the GV pulse is in the high level, and the FRP pulse is stored in the latch (RAM) 1224.

The FRP pulse stored in the latch 1224 is inverted in the inverter 1226. Since the switch 1223 is also on at this time, the inversion signal of the inverter 1226 is latched in the latch 1225 and outputted once in the reverse polarity through the inverter 1227.

After that, the switch 1222 is turned on at the timing when the CV pulse is in the high level and signal potential stored in the latch 1224 is stored in the latch (RAM) 1225 at the next stage, which is outputted as CSout through the inverter 1227.

In the case of normal drive, operation is performed without problems even in image quality.

As shown in FIG. 8, when a vertical synchronizing signal Vsync is suddenly inputted from the outside at a timing T11 which is not the regular timing and the vertical synchronizing signal Vsync becomes valid, the scanner unit (shift register) 121 is reset for maintaining display, and the process moves to an operation to store potential of the pixel electrode 112.

The scanner unit (shift register) 121 performs scanning operation from the first line again as shown by T12 in the drawing.

In the next frame, potential of reverse polarity with respect to the coupling polarity is charged in the CS lines at the same timing T13 as the gate pulse.

Specifically, in the CS latch unit 122, the switch 1221 is turned on at the timing when the GV pulse is in the high level and the FRP pulse is stored in the latch (RAM) 1224.

The FRP pulse stored in the latch 1224 is inverted in the inverter 1226. Since the switch 1223 is also on at this time, the inversion signal of the inverter 1226 is latched in the latch 1225.

Accordingly, signal potential having reverse polarity is outputted to the CS lines 142 (–1 to 142-m) through the inverter 1227 and charged in reverse polarity.

After that, the switch 1222 is turned on at the timing when the CV pulse is in the high level and signal potential stored in the latch 1224 is stored in the latch (RAM) 1225 at the next stage, which is outputted as CSout through the inverter 1227, as a result, normal coupling is performed.

That is, even in the External Vsync mode, the coupling can be performed at the intended timing T14.

The settlement of problems in the External Vsync mode was taken as the example here, however, all modes in which problems were caused in the coupling operation have been all settled.

As described above, according to the embodiment, the CS latch unit 122 in the vertical drive circuit 120 have a function of allowing the reverse polarity of potential added to the pixel electrodes to be a potential which can add suitable voltage to additional potential lines in a frame before adding the additional potential in order to prevent problems in image quality, as a result, the following advantage can be obtained.

Specifically, at the time of switching display such as vertical inversion, switching between 1H inversion and 1F inversion, on/off sequence, and an external Vsync mode (External Vsync mode), coupling operation can be performed normally, the pixel electrodes reach the intended potential, therefore, occurrence of abnormality in display can be prevented.

Therefore, at the time of switching display (such as vertical inversion, switching between 1H inversion and 1F inversion, on/off sequence, and an External Vsync mode), drive devices such as a line batch precharge or coupling polarity inversion can be omitted, which realizes simplification of the system.

The realization of system simplification allows the frame to be narrow.

In addition, modes in which problems were caused at the time of switching display until now can be cancelled.

In the above embodiment, the case in which the invention is applied to the active-matrix liquid crystal display device was explained as the example, however, the invention is not limited to this, and the invention is also applied in the same manner to other active-matrix display devices such as an EL display device in which an electroluminescence (EL) device is used as an electro-optic device of each pixel.

Additionally, the active-matrix display devices typified by the active-matrix liquid crystal display device according to the embodiment are used as displays for OA equipment (such as a personal computer, a word processor), a television receiver and the like, particularly, preferable to be used as display units for electronic equipment such as a cellular phone, PDA and the like, in which miniaturization and downsizing of the main body of the apparatus are proceeding.

Figure 9:
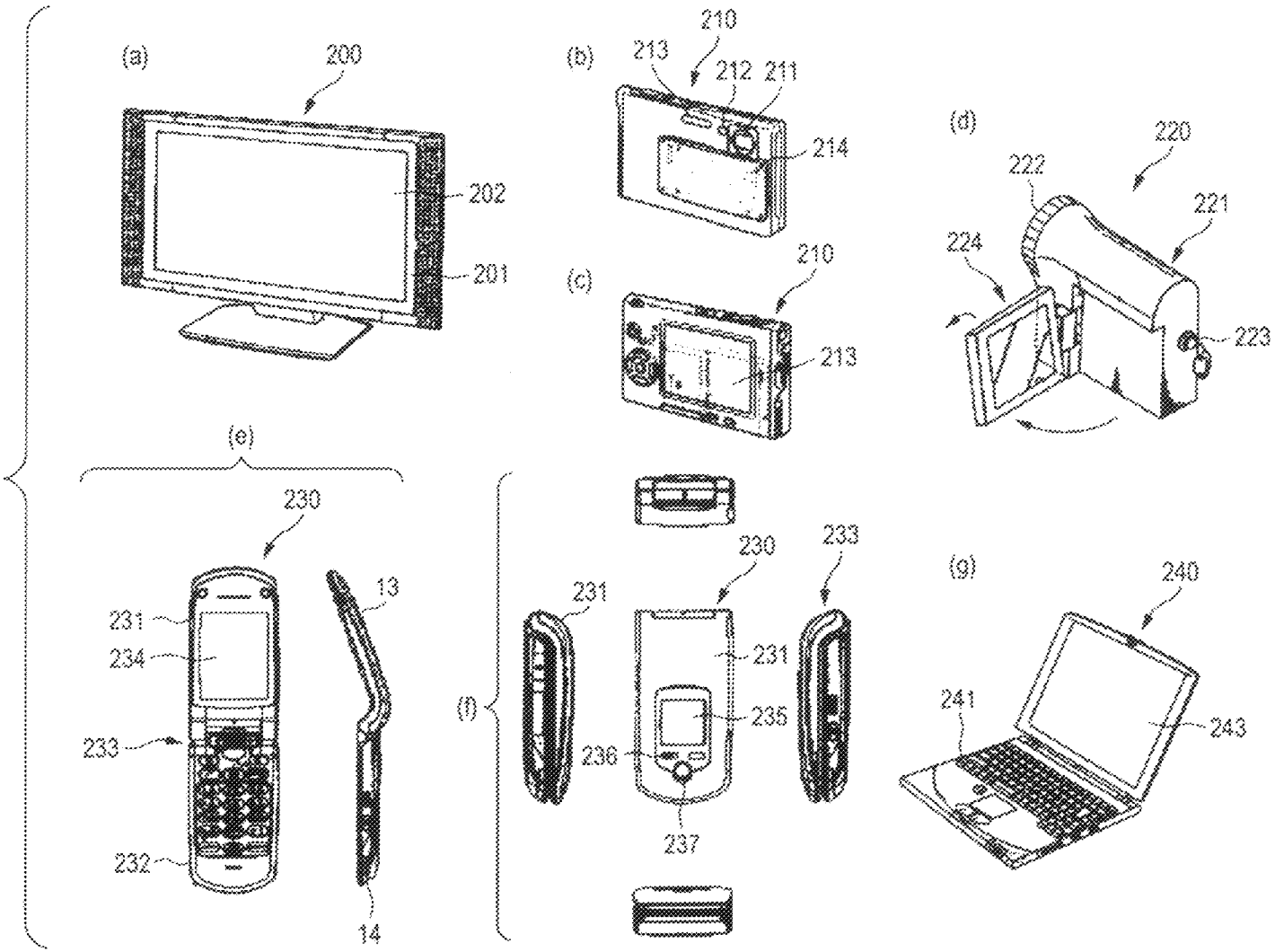
FIG. 9 illustrates views showing examples of electronic equipment to which the display device according to the embodiment of the invention is applied.

Specifically, the display device 100 according to the embodiment can be applied to display devices for various kinds of electronic equipment as shown in FIG. 9, namely, display devices for electronic equipment in various fields, for example, a digital camera, a notebook personal computer, a cellular phone, a video camera and the like, which display video signals inputted in electronic equipment or generated in the electronic equipment as images or video.

Figure 10:
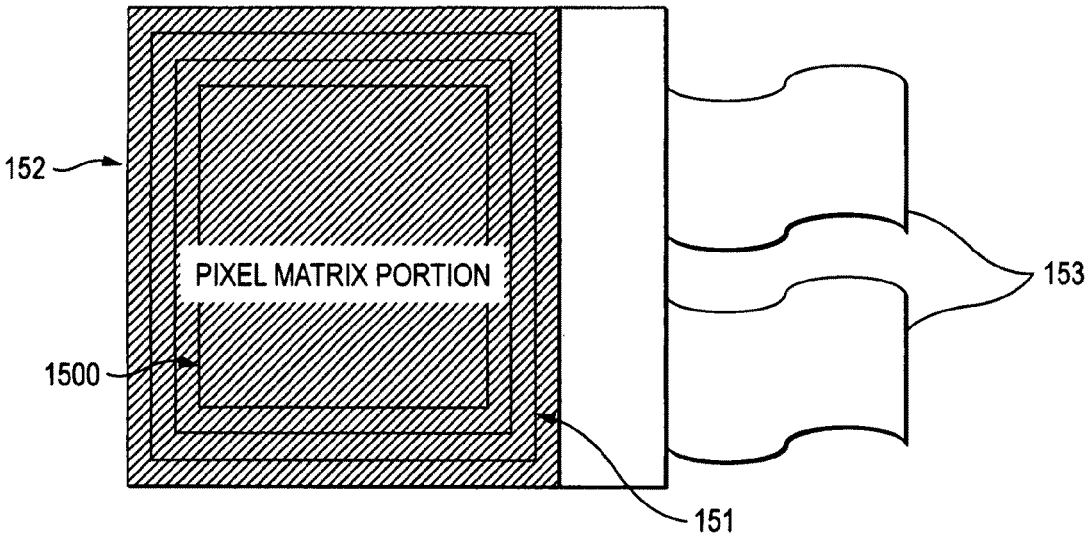
FIG. 10 is a view for explaining that the display device according to the embodiment of the invention includes a module-shaped device having a sealed configuration.

The display device according to the embodiment of the invention also includes a module-shaped device having a sealed configuration as shown in FIG. 10.

For example, a display module corresponds to the above, in which a sealing portion 151 is provided so as to surround a pixel array portion (available display area) 150 and a transparent opposite portion 152 such as glass is adhered by using the sealing portion 151 as adhesive.

It is also preferable that the transparent opposite portion 152 is provided with a color filter, a protective film, a shielding film and the like. In addition, it is preferable that the display module is provided with a FPC (flexible print circuit) 153 for inputting or outputting signals and the like to the pixel array portion from the outside.

Hereinafter, an example of electronic equipment to which the above display device is applied will be shown.

(a) in FIG. 9 shows an example of a television 200 to which the invention is applied. The television 200 includes a video display screen 203 having a front panel 201, a filter glass 202 and the like, being fabricated by using the display device according to the embodiment of the invention for the video display screen 203.

(b) and (c) in FIG. 9 show an example of a digital camera 210 to which the invention is applied. The digital camera 210 includes an imaging lens 211, a light emitting unit 212 as a flash light, a display unit 213, a control switch 214 and the like, being fabricated by using the display device according to the embodiment of the invention for the display unit 213.

(d) in FIG. 9 shows a video camera 220 to which the invention is applied. The video camera 220 includes a main body 221, a lens 222 for taking pictures of subjects at a side surface facing the front, a start/stop switch 223 when taking pictures 223, a display unit 224 and the like, being fabricated by using the display device according to the embodiment of the invention for the display unit 224.

(e) and (f) in FIG. 9 show a portable terminal apparatus 230 to which the invention is applied. The portable terminal apparatus 230 includes an upper casing 231, a lower casing 232, a connecting portion (a hinge portion in this case) 233, a display 234, a sub-display 235, a picture light 236, a camera 237 and the like, being fabricated by using the display device according to the embodiment of the invention for the display 234 or the sub-display 235.

(g) in FIG. 9 shows a notebook personal computer 240 to which the invention is applied. The notebook personal computer 240 includes a main body 241, a keyboard 242 operated when inputting characters and the like, a display unit 243 displaying images and the like, being fabricated by using the display device according to the embodiment of the invention for the display unit 243.

It should be understood by those skilled in the art that various modifications, combinations, sub-combinations and alterations may occur depending on design requirements and other factors insofar as they are within the scope of the appended claims or the equivalents thereof.

What is claimed is:

1. A display device, comprising:

a display unit in which pixels are arranged in a matrix state; and a drive circuit selecting respective pixels in the display unit by each row and giving additional potential to pixel electrodes of the pixels by using coupling, and wherein the drive circuit is configured to cause the reverse polarity of potential added to pixel electrodes to be a potential which can add suitable voltage to additional potential lines in a frame before adding the additional potential;

scanning lines, auxiliary lines as additional potential line and signal lines arranged according to a matrix arrangement of pixels, and wherein each pixel includes a pixel cell, a switching element connecting the signal line to the pixel electrode of the pixel cell selectively according to the level of the scanning line, and a storage capacitor in which one electrode is connected to the pixel electrode and the other electrode is connected to the corresponding auxiliary line, and wherein the drive circuit outputs a target potential having reverse polarity to the scanning lines and the auxiliary lines at the predetermined timing.

2. The display device according to claim 1, wherein the drive circuit includes a scanner unit having a function of generating a first pulse and a second pulse, a latch unit having a latch latching a polarity pulse at the second-pulse timing and an inversion transfer unit inverting the level of the polarity pulse at the first-pulse timing and inputting the pulse to the latch.

3. The display device according to claim 2, wherein the drive circuit includes a scanner unit having a function of generating a first pulse and a second pulse, and a latch unit having a first latch latching a polarity pulse at the first-pulse timing, a second latch latching the latch signal of the first latch at the second-pulse timing and an inversion transfer unit inverting the level of the latch signal of the first latch at the first-pulse timing and inputting the signal to the second latch.

4. The display device according to claim 2, wherein the scanner unit has a function of performing scanning operation again when being reset at the time of switching display.

5. The display device according to claim 4, wherein the latch unit charges the auxiliary line to the target potential when being reset.

6. An electronic equipment, comprising:

a display device and wherein the display device includes a display unit in which pixels are arranged in a matrix state, and a drive circuit selecting respective pixels in the display unit by each row and giving additional potential to pixel electrodes of the pixels by using coupling, and wherein the drive circuit has a function of allowing the reverse polarity of potential added to pixel electrodes to be a potential which can add suitable voltage to additional potential lines in a frame before adding the additional potential;

scanning lines, auxiliary lines as additional potential line and signal lines arranged according to a matrix arrangement of pixels, and wherein each pixel includes a pixel cell, a switching element connecting the signal line to the pixel electrode of the pixel cell selectively according to the level of the scanning line, and a storage capacitor in which one electrode is connected to the pixel electrode and the other electrode is connected to the corresponding auxiliary line, and wherein the drive circuit outputs a target potential having reverse polarity to the scanning lines and the auxiliary lines at the predetermined timing.

7. The electronic equipment according to claim 6, wherein the drive circuit includes a scanner unit having a function of generating a first pulse and a second pulse, a latch unit having a latch latching a polarity pulse at the second-pulse timing and an inversion transfer unit inverting the level of the polarity pulse at the first-pulse timing and inputting the pulse to the latch.

8. The electronic equipment according to claim 7, wherein the drive circuit includes a scanner unit having a function of generating a first pulse and a second pulse, and a latch unit having a first latch latching a polarity pulse at the first-pulse timing, a second latch latching the latch signal of the first latch at the second-pulse timing and an inversion transfer unit inverting the level of the latch signal of the first latch at the first-pulse timing and inputting the signal to the second latch.

9. The electronic equipment according to claim 7, wherein the scanner unit has a function of performing scanning operation again when being reset at the time of switching display.

10. The electronic equipment according to claim 9, wherein the latch unit charges the auxiliary line to the target potential when being reset.

* * * * *